US009671712B2

(12) United States Patent
Hirota

(10) Patent No.: US 9,671,712 B2
(45) Date of Patent: Jun. 6, 2017

(54) IMAGE FORMING APPARATUS

(71) Applicant: CANON KABUSHIKI KAISHA, Tokyo (JP)

(72) Inventor: Shingo Hirota, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/229,089

(22) Filed: Aug. 4, 2016

(65) Prior Publication Data

US 2017/0060017 A1 Mar. 2, 2017

(30) Foreign Application Priority Data

Aug. 25, 2015 (JP) ..... 2015-165920

(51) Int. Cl.
*G03G 15/02* (2006.01)

(52) U.S. Cl.
CPC ..... *G03G 15/0266* (2013.01)

(58) Field of Classification Search
None
See application file for complete search history.

(56) References Cited

U.S. PATENT DOCUMENTS

| | | | | |
|---|---|---|---|---|
| 5,485,248 | A | 1/1996 | Yano et al. | 355/206 |
| 7,826,754 | B2 | 11/2010 | Kurita et al. | 399/26 |
| 2001/0046388 | A1* | 11/2001 | Inoue | G03G 15/0266 399/44 |
| 2007/0140714 | A1* | 6/2007 | Kurita | G03G 15/5037 399/44 |
| 2008/0122460 | A1* | 5/2008 | Ichikawa | G01B 7/06 324/699 |
| 2010/0239286 | A1* | 9/2010 | Hanashi | G03G 15/0266 399/50 |
| 2013/0195475 | A1* | 8/2013 | Kubo | G03G 15/553 399/26 |

FOREIGN PATENT DOCUMENTS

| | | |
|---|---|---|
| JP | H05-223513 | 8/1993 |
| JP | H08-146677 | 6/1996 |
| JP | 2007-171470 | 7/2007 |

* cited by examiner

*Primary Examiner* — David M Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes: a power source applying voltage to a charging roller to charge a photosensitive drum; a toner-image forming unit forming a toner image on the photosensitive drum; a detecting member which detects a DC current to be flowed from the charging roller to the photosensitive drum; a driving source driving the photosensitive drum at a predetermined speed; and an execution unit executing a detection mode to detect the DC current with the detecting member when the voltage is applied in a state in which the photosensitive drum is rotated, in a period except a period during which the toner image is formed on the photosensitive drum, the execution unit setting a speed of the driving source when the detection mode is executed at a second speed faster than a first speed that is fastest in the period during which the toner image is formed.

6 Claims, 7 Drawing Sheets

IMAGE FORMING APPARATUS

BACKGROUND OF THE INVENTION

Field of the Invention

The present invention relates to an image forming apparatus, which forms an image on a recording medium by using, for instance, an electrophotographic image forming system, such as an electrophotographic copying machine, an electrophotographic printer (for instance, laser beam printer and LED printer) and a facsimile apparatus.

Description of the Related Art

As for a photosensitive member which is used in an electrophotographic type of image forming apparatus, an organic electrophotographic photosensitive member has become prevalent which has a photosensitive layer (organic photosensitive layer) that is made of an organic material as a photoconductive material (charge-generating material and charge-transporting material) provided on a support made from a metal, because of having advantages of low cost and high productivity. As for the organic electrophotographic photosensitive member, an electrophotographic photosensitive member is a mainstream, which has a lamination type photosensitive layer in which a charge-transporting layer that contains a charge-transporting material which is a photoconductive polymer or a photoconductive low-molecular compound is laminated on a charge-generating layer that contains a charge-generating material which is a photoconductive dye or a photoconductive pigment. Thereby, high sensitivity, and diversity of material design is achieved.

To the surface of this photosensitive member, an electric external force and a mechanical external force are applied in an image-forming process. Because of this, durability against the occurrence of scratch and wear on the surface originating in these external forces, in other words, scratch resistance and wear resistance are required. In order to enhance these scratch resistance and wear resistance, in recent years, such a technology is established as to enhance a mechanical strength of the surface layer by using a hardened layer for the surface layer of a photosensitive member. For instance, there is a photosensitive member which includes a hardened layer that is made of a hardening resin as a binder resin, for the surface layer.

However, even though the photosensitive member having the hardened layer as the surface layer is used, the wear of the surface cannot be perfectly prevented. When the hardened layer is worn as the photosensitive drum is used for a long period, the photosensitive layer existing in the lower layer of the hardened layer is exposed, and the wear of the photosensitive layer starts. This photosensitive layer is weak against the mechanical external force, and is rapidly worn from the exposed portion. When the wear of the photosensitive layer which is an insulator progresses, an electric charge results in moving to a support, which is made from a metal and exists in the lower layer of the photosensitive layer, in a worn portion, and the photosensitive layer becomes unable to retain the electric charge. As a result, an image failure occurs in the worn portion.

For this reason, a method for detecting a film thickness of the photosensitive member is conventionally proposed. In Japanese Patent Application Laid-Open No. H05-223513, for instance, a DC current, which flows to the photosensitive member when a voltage is applied to a charging member for charging a photosensitive member to charge the photosensitive member up to a predetermined potential, is detected. A film thickness of the photosensitive member is calculated from the detected current value.

In the configuration of Japanese Patent Application Laid-Open No. H05-223513, the DC current to be detected when the film thickness is detected is generated when the surface of the photosensitive member which is not charged is charged by the charging member. Because of this, the DC current which is detected when the film thickness is detected depends on an area per unit time period of the photosensitive member that enters into a charging portion for charging the photosensitive member. The area of the photosensitive member which enters into the charging portion depends on a rotational speed of the photosensitive member.

Because of this, when the rotational speed of the photosensitive member is, for instance, 200 mm/s which is slower than 400 mm/s, the DC current to be detected becomes small with respect to the film thickness of the photosensitive member, as is illustrated in FIG. 7. If the film thickness decreases as the photosensitive drum is used for a long period, the increase amount of the DC current which is detected becomes small as compared to the decrease amount of the film thickness. In this circumstance, if there is a detection error of the DC current, when the film thickness is calculated, the calculation is easily affected by the error.

SUMMARY OF THE INVENTION

The present invention provides an image forming apparatus that includes: a photosensitive drum which rotates; a charging roller which is arranged so as to come into contact with or close to the photosensitive drum; a power source which applies voltage to the charging roller to charge the photosensitive drum; a toner-image forming unit which performs image exposure on the charged photosensitive drum based on an image signal, and then forms a toner image on the photosensitive drum by depositing a toner thereon; a detecting member which detects a DC current to be flowed from the charging roller to the photosensitive drum; a driving source which drives to rotate the photosensitive drum at a predetermined speed; and an execution unit which executes a detection mode to detect the DC current, that flows from the charging roller to the photosensitive drum, with the detecting member when the voltage is applied to the charging roller in a state in which the photosensitive drum is rotated, in a period except a period during which the toner image is formed on the photosensitive drum, the execution unit which sets a speed of the driving source at the time when the detection mode is executed at a second speed which is faster than a first speed that is fastest in the period during which the toner image is formed by the toner-image forming unit.

Further features of the present invention will become apparent from the following description of exemplary embodiments with reference to the attached drawings.

DESCRIPTION OF THE EMBODIMENTS

Embodiment

<Image Forming Apparatus>

The whole configuration of an image forming apparatus A according to a first embodiment of the present invention will be described below together with an operation at the time when an image is formed, with reference to the drawings.

Figure 1:
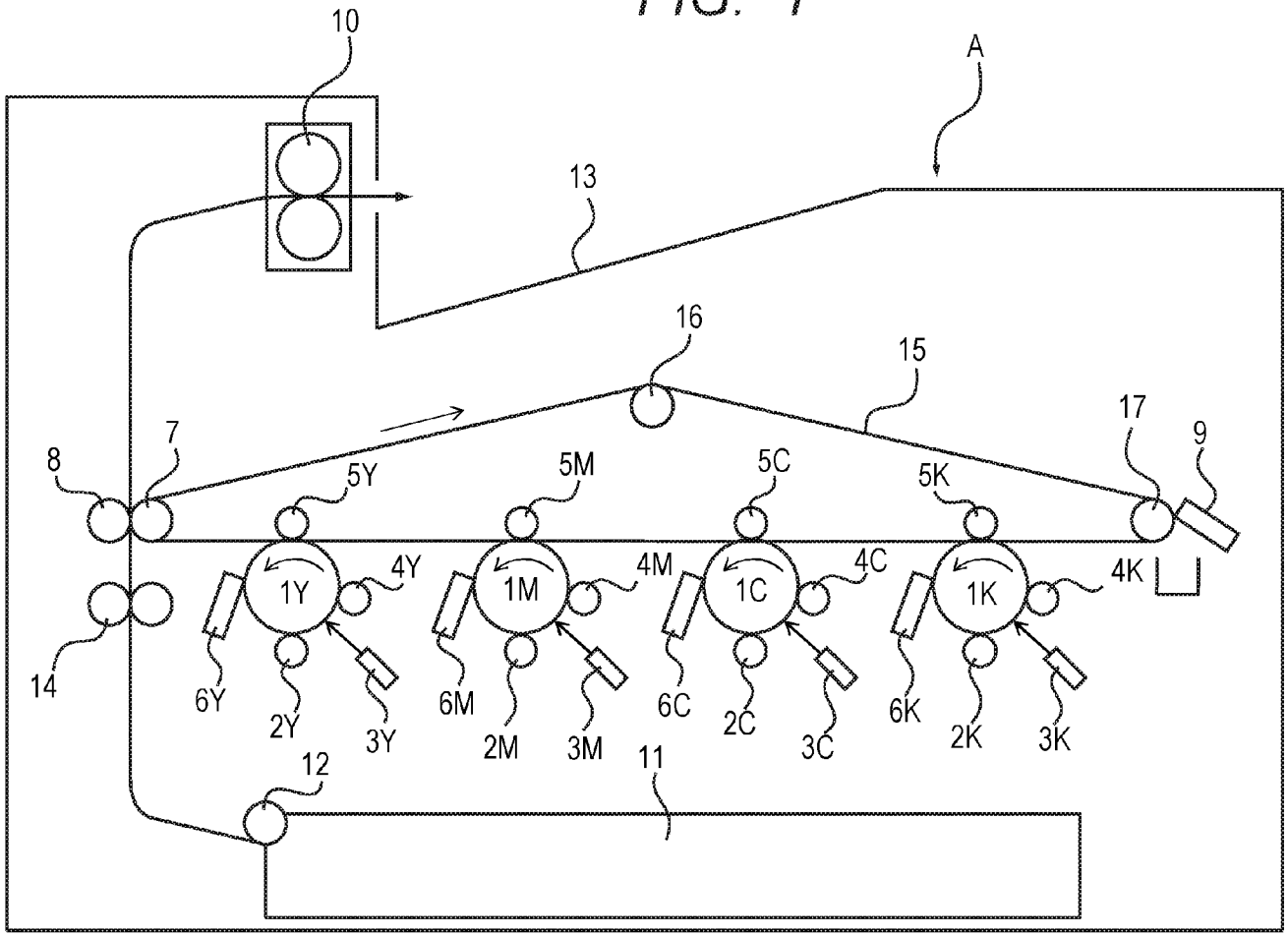
FIG. 1 is a schematic sectional view of an image forming apparatus.

The image forming apparatus A includes: an image forming portion which transfers a toner image onto a sheet; a sheet feeding section which feeds the sheet to the image forming portion; and a fixing section which fixes the toner image onto the sheet, as is illustrated in FIG. 1.

The image forming portion has photosensitive drums 1 (1Y, 1M, 1C and 1K) which are rotating drum type of organic electrophotographic photosensitive members that are rotatably provided as image bearing members. In addition, the image forming portion includes contact charging type of charging rollers 2 (2Y, 2M, 2C and 2K) which uniformly charge the surface of the photosensitive drum 1, as charging members. In addition, the image forming portion has plate-like cleaning blades 6 (6Y, 6M, 6C and 6K) made from urethane rubber; laser scanner units 3 (3Y, 3M, 3C and 3K), developing devices 4 (4Y, 4M, 4C and 4K), and an intermediate transfer unit.

Figure 2:
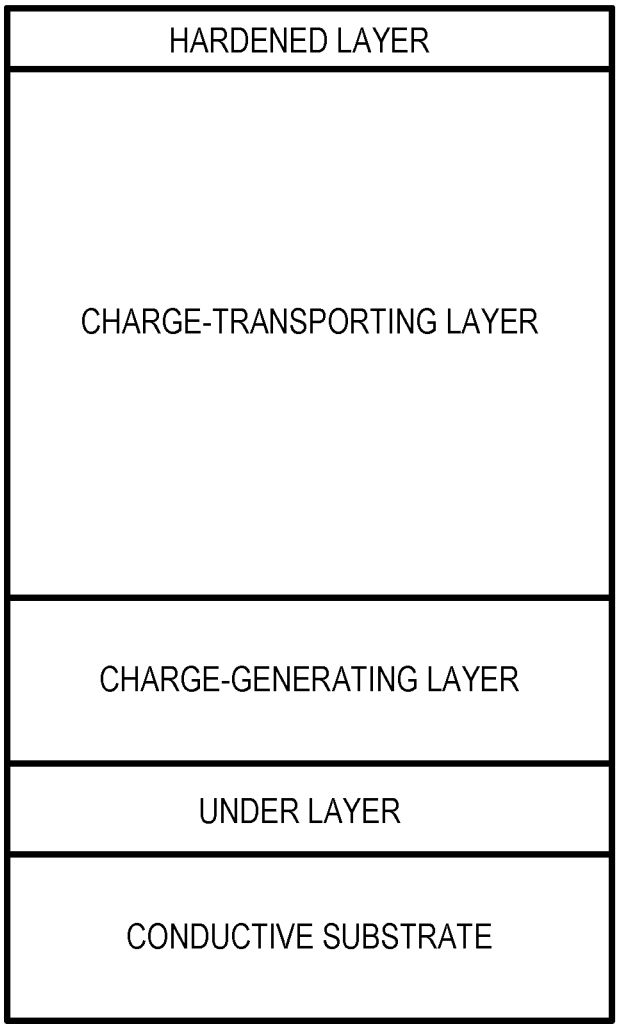
FIG. 2 is a view for explaining a layer structure of a photosensitive drum.

The photosensitive drum 1 is formed by coating an under layer, and a charge-generating layer, a charge-transporting layer and a hardened layer that are made from organic materials on a surface of an aluminum cylinder that acts as a conductive base. These layers are coated from the undermost layer in this order, as is illustrated in FIG. 2. In the present embodiment, a hardened layer is used which is made of a hardening resin as a binder resin, as surface hardening treatment for the photosensitive drum 1. However, the hardened layer is not limited to the above hardened layer, but a charge transporting hardened layer, that is formed of, for instance, a monomer having a carbon-carbon double bond and a charge transporting monomer which are cured by polymerization by thermal or optical energy, can be used as the hardened layer. In addition, a charge transporting hardened layer, which is formed of a hole transporting compound that has a chain polymerizable functional group in the same molecule and cured by polymerization by energy of an electron beam, may be used as the surface layer.

The charging roller 2 includes a cored bar made from stainless steel, and a conductive rubber layer which is formed in an outer periphery of the cored bar. Both ends of this cored bar are each rotatably held by a bearing member, and is brought into pressure contact with the surface of the photosensitive drum 1, by a pressing spring.

The intermediate transfer unit includes primary transfer rollers 5 (5Y, 5M, 5C and 5K), an intermediate transfer belt 15, a driving roller 16, a tension roller 17, a secondary transfer roller 7, a secondary-transfer opposing roller 8 and a cleaning device 9. The intermediate transfer belt 15 is an endless cylindrical belt, and is suspended by the driving roller 16, the tension roller 17 and the secondary transfer roller 7.

Figure 3:
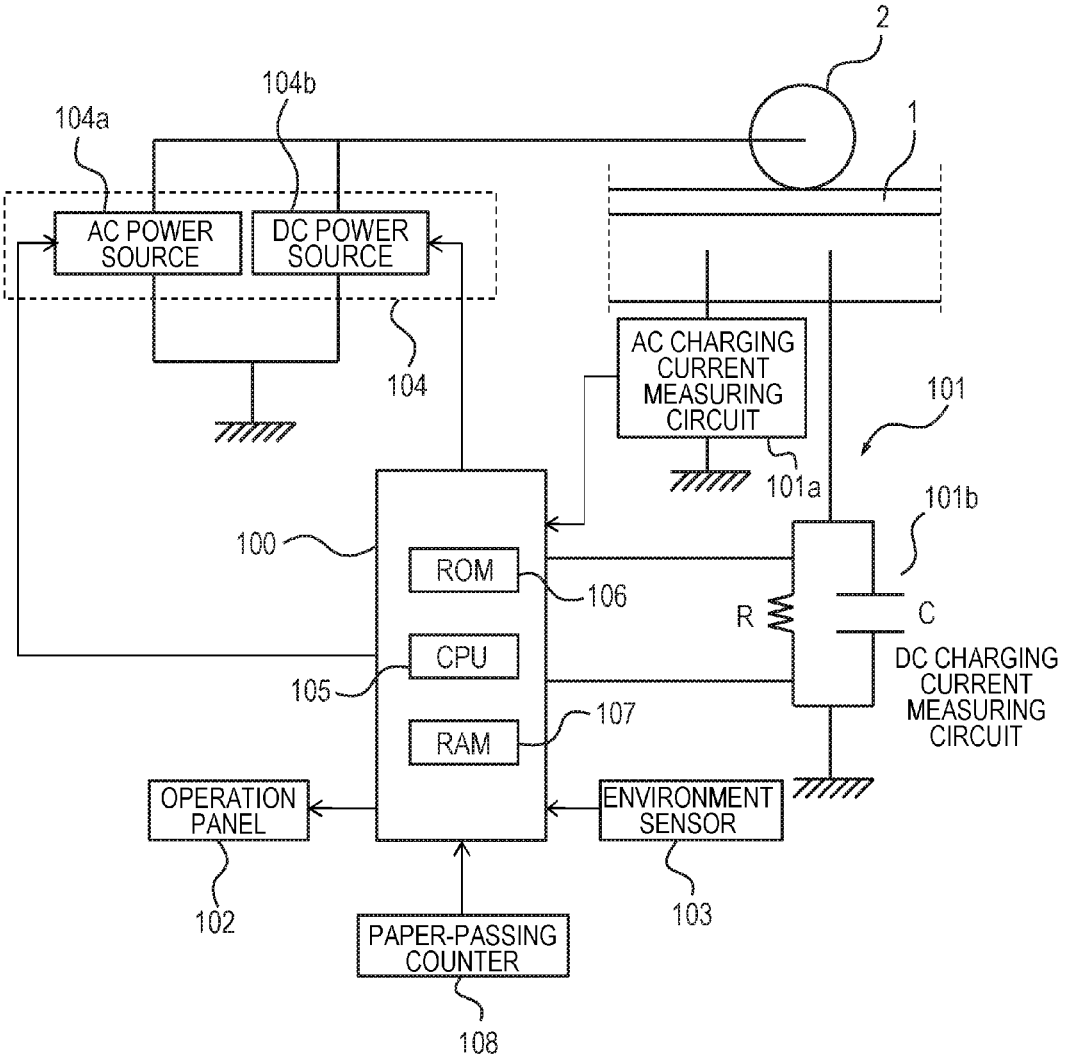
FIG. 3 is a block diagram illustrating a configuration of a system of the image forming apparatus.

When the image is formed, a control unit 100 illustrated in FIG. 3 emits a print signal, and then a sheet which is stacked and stored in a sheet stacking unit 11 is fed to a sheet conveying path by a feeding roller 12. The fed sheet is conveyed to the image forming portion by the conveying roller 14.

In the image forming portion, the photosensitive drum 1 rotates by receiving a driving force from a driving source such as a motor (unillustrated), and the charging roller 2 is driven to rotate by the rotation of the photosensitive drum 1. At this time, a predetermined charging voltage is applied to the charging roller 2 by the charging power source 104 illustrated in FIG. 3. As for the charging voltage at the time of image formation, in the present embodiment, the DC voltage is set at −500 V, and the AC voltage is set at a value twice or more as large as a discharge starting voltage at the time when the photosensitive drum 1 starts discharge in the environment of image formation. Thereby, the surface of the photosensitive drum 1 is charged at approximately −500 V, by using a discharge phenomenon which occurs in a microgap between the charging roller 2 and the photosensitive drum 1. In the present embodiment, the photosensitive drum 1 at the time of the image formation rotates around a central support shaft at a peripheral velocity of 200 mm/s. The charging roller 2 is driven to rotate at a peripheral velocity of 300 mm/s by the rotation of the photosensitive drum 1.

After the photosensitive drum 1 is charged, the laser scanner unit 3 emits a laser beam from an unillustrated light source provided in the laser scanner unit 3, and irradiates the photosensitive drum 1 with the laser beam. Thereby, an electrostatic latent image is formed on the surface of the photosensitive drum 1.

This electrostatic latent image is developed on the photosensitive drum 1 as the toner image, by bringing a developing sleeve (unillustrated) provided in the developing device 4 into contact with the photosensitive drum 1. In order to enhance a rate of giving the toner to the electrostatic latent image, the developing voltage is applied to the developing sleeve from an unillustrated developing power source. In the present embodiment, an oscillation voltage is applied as the developing voltage, which is generated by superimposing an AC voltage on a DC voltage. The AC voltage is a rectangular wave voltage, and has a frequency of 8.0 kHz and a peak-to-peak voltage of 1.8 kV. As for a toner to be used for development in the present embodiment, the toner having an average particle size of approximately 6 μm was used. The toner is obtained by kneading a pigment with a resin binder that mainly contains polyester and pulverizing and classifying the resultant pigment. The average amount of charge of the toner which deposits on the photosensitive drum 1 is approximately −30 μC/g.

In a primary-transfer nip portion which is formed by the primary transfer roller 5 (transfer member) and the photosensitive drum 1, a primary transfer voltage is applied to the primary transfer roller 5 from an unillustrated transfer power source (transfer-voltage applying unit). Thereby, the toner images which have been formed on the respective photosensitive drums 1 are each primarily transferred onto the intermediate transfer belt 15 (object to be transferred). In the present embodiment, the primary transfer voltage at the time when the image is formed is set at 600 V.

The driving roller 16 is rotated by receiving a rotational power from the driving source, and thereby the intermediate transfer belt 15 is rotated. The toner image which has been primarily transferred onto the intermediate transfer belt 15 reaches a secondary-transfer nip portion which is located downstream in a rotation direction of the intermediate transfer belt 15 and is formed of a secondary transfer roller 7 and a secondary-transfer opposing roller 8. After that, the toner image is transferred onto the sheet in the secondary transfer portion.

The sheet on which the toner image has been transferred is sent to a fixing device 10, in which the toner image is fixed on the sheet by being heated and pressurized, and then the sheet is delivered to a delivery portion 13.

<Control Unit>

Next, a system configuration of an image forming apparatus A, such as a control configuration for a charging voltage to be applied to the charging roller 2, will be described below. As is illustrated in FIG. 3, the image forming apparatus A has a control unit 100 including a CPU 105, a ROM 106 and a RAM 107. This control unit 100 performs various controls concerning image formation, such as a control of a rotational speed of the photosensitive drum 1, controls of the charging power source 104, the developing power source and the transfer power source, and a control which will be described later. The ROM 106 and the RAM 107 may be a memory in a substrate in the image forming apparatus A or a memory in a tag which is installed in a drum cartridge.

The control unit 100 is connected to the charging power source 104 (voltage applying unit) for applying a charging voltage. This charging power source 104 includes an AC charging power source 104*a* which applies a AC charging voltage to the charging roller 2, and a DC charging power source 104*b* which applies a DC charging voltage thereto.

In addition, the control unit 100 is connected to a current detecting circuit 101 which is formed between the photosensitive drum 1 and a ground potential. This current detecting circuit 101 has a AC charging current measuring circuit 101*a* which measures a AC charging current that flows to the photosensitive drum 1 from the charging roller 2, due to the AC charging voltage applied by the AC charging power source 104*a*. In addition, the current detecting circuit 101 has a DC charging current measuring circuit 101*b* which measures the DC charging current I that flows to the photosensitive drum 1 from the charging roller 2, due to the DC charging voltage applied by the DC charging power source 104*b*.

The DC charging current measuring circuit 101*b* has a resistance R and a capacitor C, measures a voltage between terminals of the resistance R, and calculates the DC charging current I from the measured value. The capacitor C bypasses the AC charging current.

In addition, the control unit 100 is connected to an operation panel 102 through which a user performs various settings of a sheet size, a basis weight and the like, and connected to an environment sensor 103 that detects an environment in which the image forming apparatus A is placed, for instance, temperature or humidity. The control unit 100 controls operation panel 102 and the environment sensor 103. In addition, the control unit 100 is connected to a paper-passing counter 108, and thereby detects the number of sheets each having an image formed thereon.

<Film-Thickness Detection Sequence>

Next, a film-thickness detection sequence which detects the film thickness of the photosensitive drum 1 will be described below.

Before the film-thickness detection sequence is described, a method for calculating a film thickness of the photosensitive drum 1 will be described below. As for the film thickness of the photosensitive drum 1, the film thickness d is defined as a distance between the surface of the photosensitive layer and the surface of the conductive base. At this time, a relationship of the following Expression 1 is established, when an amount of electric charges per unit area given to the photosensitive layer is represented by Q, a surface potential of the photosensitive drum 1 given by the charging roller 2 is represented by V, an electrical capacitance per unit area of the photosensitive layer is represented by C, a dielectric constant in a vacuum is represented by $\in 0$, and a relative permittivity of the photosensitive layer is represented by $\epsilon r$.

$$Q=CV=\in 0\times\in r\times 1/d\times V \quad \text{(Expression 1)}$$

It can be understood from the above described Expression 1 that the amount Q of the electric charge is inversely proportional to the film thickness d. Here, the dielectric constant $\in 0$ in the vacuum and the relative permittivity $\in r$ of the photosensitive layer are constant. Because of this, if the amount Q of the electric charge per unit area, which is given to the photosensitive layer when the surface potential V of the photosensitive drum 1 given by the charging roller 2 is set at a predetermined potential, is obtained, the film thickness d can be calculated. Specifically, the film thickness d can be calculated by measuring the DC charging current I (current value), which flows to the photosensitive drum 1 when the photosensitive drum 1 is charged with the charging roller 2 by applying the DC charging voltage.

In order to detect the film thickness of the photosensitive drum 1 with higher accuracy, it is also possible to detect the film thickness of the photosensitive drum 1 from a difference value $\Delta I$ between the DC charging current I, which is detected in an initial use stage of the photosensitive drum 1, and the DC charging current I, which is detected when the film-thickness detection sequence is executed. This is a method of estimating the film thickness from the viewpoint of how deep the film is worn with respect to a determined film thickness.

Figure 4:
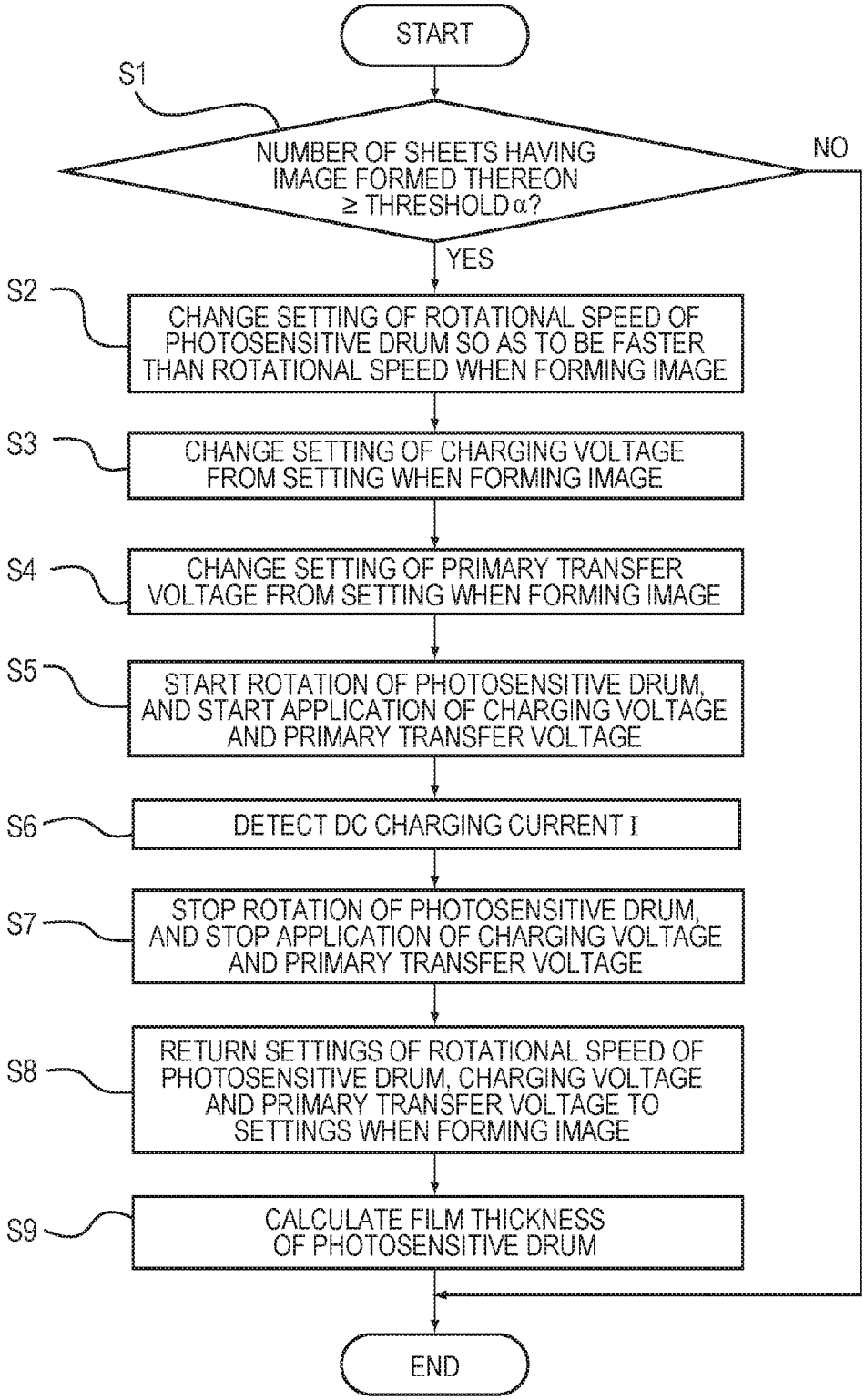
FIG. 4 is a flow chart of a film-thickness detection sequence.

Next, the film-thickness detection sequence will be described below with reference to a flow chart of FIG. 4. As is illustrated in FIG. 4, when the film-thickness detection sequence starts, firstly, the control unit 100 determines whether or not the number of sheets each having an image formed thereon, which has been detected by the paper-passing counter 108, is not less than a threshold $\alpha$ (S1). Here, when the number of sheets each having an image formed thereon is less than the threshold $\alpha$, the film thickness is not detected, and the film-thickness detection sequence ends.

When the number of sheets each having an image formed thereon is the threshold $\alpha$ or more, the control unit 100 subsequently changes the setting of the rotational speed of the photosensitive drum 1 to a rotational speed which is faster than the rotational speed at the time when the image is formed (S2). The rotational speed of the photosensitive drum 1 may be a rotational speed at which the charging roller 2 can sufficiently charge the surface of the photosensitive drum 1 when the DC charging voltage is applied to the charging roller 2. In the present embodiment, the rotational speed is changed to 400 mm/s, from 200 mm/s at the time when the image is formed.

Next, the control unit 100 changes the setting of the charging voltage to be applied to the charging roller 2 when the DC charging current I is detected, because of the reason which will be described later. Specifically, the control unit 100 changes the settings of the DC charging voltage and the AC charging voltage, from the settings at the time when the image is formed (S3). It is not always necessary to apply the AC charging voltage in order to detect the DC charging current I. However, the charging oscillation voltage which is generated by superimposing the AC charging voltage on the DC charging voltage can be applied, because of the reason which will be described below. Because of this, in the present embodiment, when the DC charging current I is detected, the oscillation voltage shall be applied.

Figure 5A:
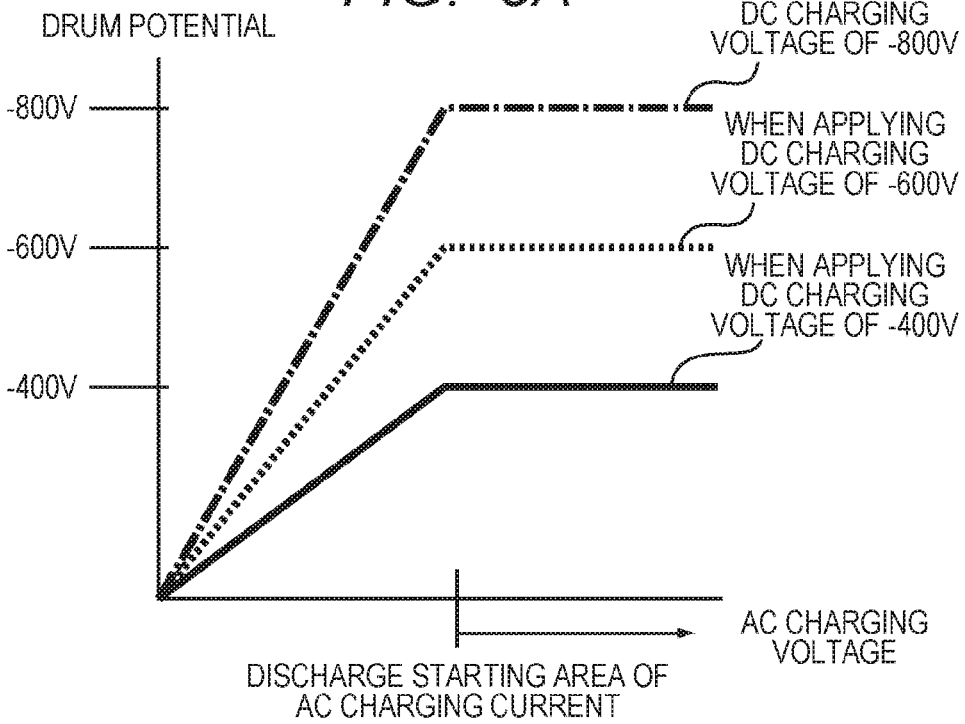
FIGS. 5A and 5B are graphs illustrating relationships among AC charging voltages, a drum potential and a DC charging current.
Figure 5B:
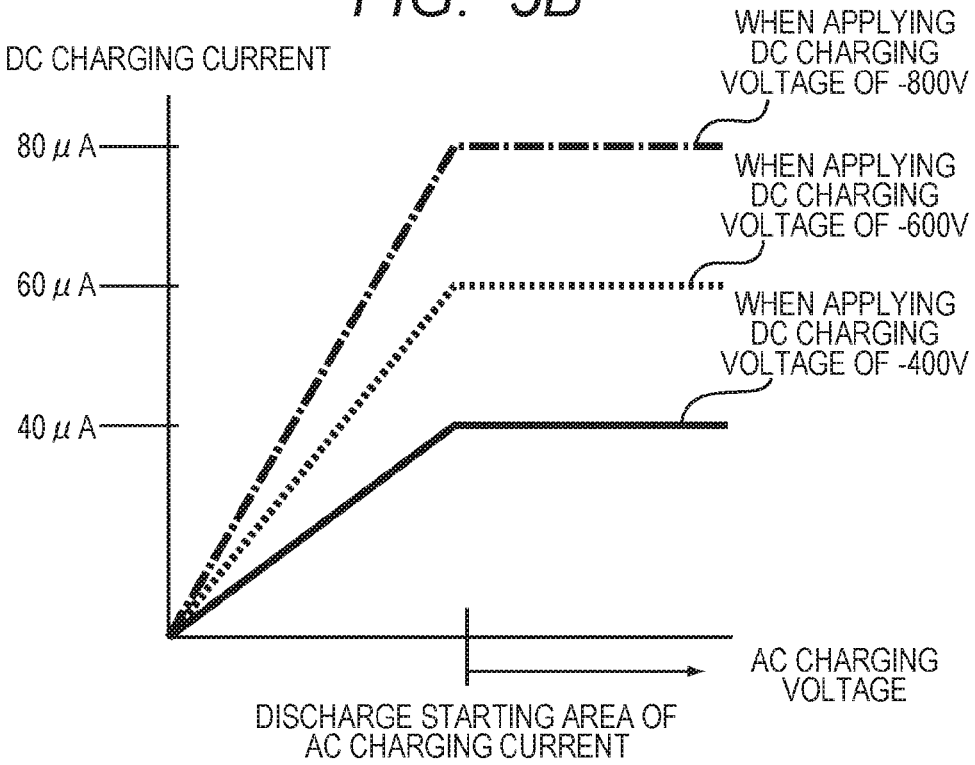

FIGS. 5A and 5B are graphs illustrating a relationship among the AC charging voltage, a charged potential of the photosensitive drum 1 (hereinafter referred to as drum potential), and the DC charging current I. As is illustrated in FIG. 5A, if the AC charging voltage is not applied, the DC charging voltage which is applied to the charging roller 2 cannot be sufficiently reflected in the drum potential. Specifically, when the AC charging voltage is applied, the charging roller 2 applies a AC charging voltage that is larger than a discharge starting voltage at which the charging roller 2 starts discharge of the AC charging current that is an AC current, to the photosensitive drum 1. Thereby, the DC charging voltage which is applied to the charging roller 2 can be reflected in the drum potential. The AC charging voltage larger than the discharge starting voltage is applied, therefore a relationship between the DC charging voltage and the DC charging current I is also stabilized, as is illustrated in FIG. 5B. Accordingly, a charging oscillation voltage, which is generated by superimposing the AC charging voltage larger than the discharge starting voltage on the DC charging voltage, is applied. Thereby, the DC charging voltage is accurately reflected in the DC charging current I, and the film thickness can be more accurately calculated.

When the rotational speed of the photosensitive drum 1 increases, a larger AC charging voltage needs to be applied, otherwise the AC charging current becomes not to be discharged. Accordingly, in order to stabilize the relationship between the DC charging voltage to be applied and the DC charging current I and to accurately calculate the film thickness, the AC charging voltage, which is applied when the DC charging current I is detected, needs to be reset so as to become larger as the rotational speed of the photosensitive drum 1 increases.

Then, the control unit 100 detects a AC charging current which flows to the photosensitive drum 1 when the AC charging voltage is applied. The control unit 100 sets the AC charging voltage at which the AC charging current sufficiently flows, as the AC charging voltage to be applied when the DC charging current I is detected. In the present embodiment, a AC charging voltage is set so that the AC charging current becomes 40 μA. Thereby, the applied DC charging voltage is accurately reflected in the DC charging current I, and the film thickness can be more accurately calculated.

In the present embodiment, the DC charging voltage is set at −700 V, which is applied to the charging roller 2 when the DC charging current I is detected. This DC charging voltage may be basically any voltage. However, as the DC charging value is larger, the DC charging current I also increases, and accordingly the DC charging voltage can be increased up to such a voltage as not to cause a harmful effect such as leakage.

Next, the control unit 100 changes the setting of the primary transfer voltage to be applied to the primary transfer roller 5 when the DC charging current I is detected, from the setting at the time when the image is formed (S4). In the present embodiment, in order to reset the drum potential, a primary transfer voltage having reverse polarity to that of the charging voltage is applied to the primary transfer roller 5. When the rotational speed of the photosensitive drum 1 increases, the primary transfer voltage necessary for resetting the drum potential also increases. Because of this, this primary transfer voltage also needs to be reset anew. In the present embodiment, the control for resetting the primary transfer voltage is referred to as a primary transfer ATVC control.

The primary transfer ATVC control may be any control as long as the control can determine the primary transfer voltage for forming such a transfer potential as to be capable of resetting the charged potential of the photosensitive drum 1. In the present embodiment, the primary transfer current is detected which is generated by a difference between the drum potential and the potential of the primary transfer roller 5, when the region of the charged photosensitive drum 1 enters into the primary-transfer nip portion. The primary transfer voltage is set at such a voltage that the primary transfer current becomes a predetermined value. Specifically, in the present embodiment, the primary transfer voltage is set at such a DC voltage that the primary transfer current becomes 30 μA.

When the settings of the charging voltage and the primary transfer voltage is completed, next, the control unit 100 rotates the photosensitive drum 1, and starts the application of the charging voltage and the primary transfer voltage (S5).

Next, the control unit 100 detects the DC charging current I by the DC charging current measuring circuit 101*b* (S6). As for the methods for detecting the DC charging current I, there are a method of detecting the DC charging current I only once, and a method of detecting the DC charging current I a plurality of times at predetermined time intervals to take the average value.

After detection of the DC charging current I, the control unit 100 stops the rotation of the photosensitive drum 1, and stops the application of the charging voltage and the primary transfer voltage (S7). After that, the control unit 100 returns the rotational speed of the photosensitive drum 1 to the setting of 200 mm/s which is the speed at the time when the image is formed, in order to prepare for the image formation. In addition, the control unit 100 returns the set values of the charging voltage and the primary transfer voltage to the settings at the time when the image is formed (S8).

Next, the control unit 100 calculates the film thickness of the photosensitive drum 1 from the value of the detected DC charging current I, according to the previously described calculation method (S9).

Figure 7:
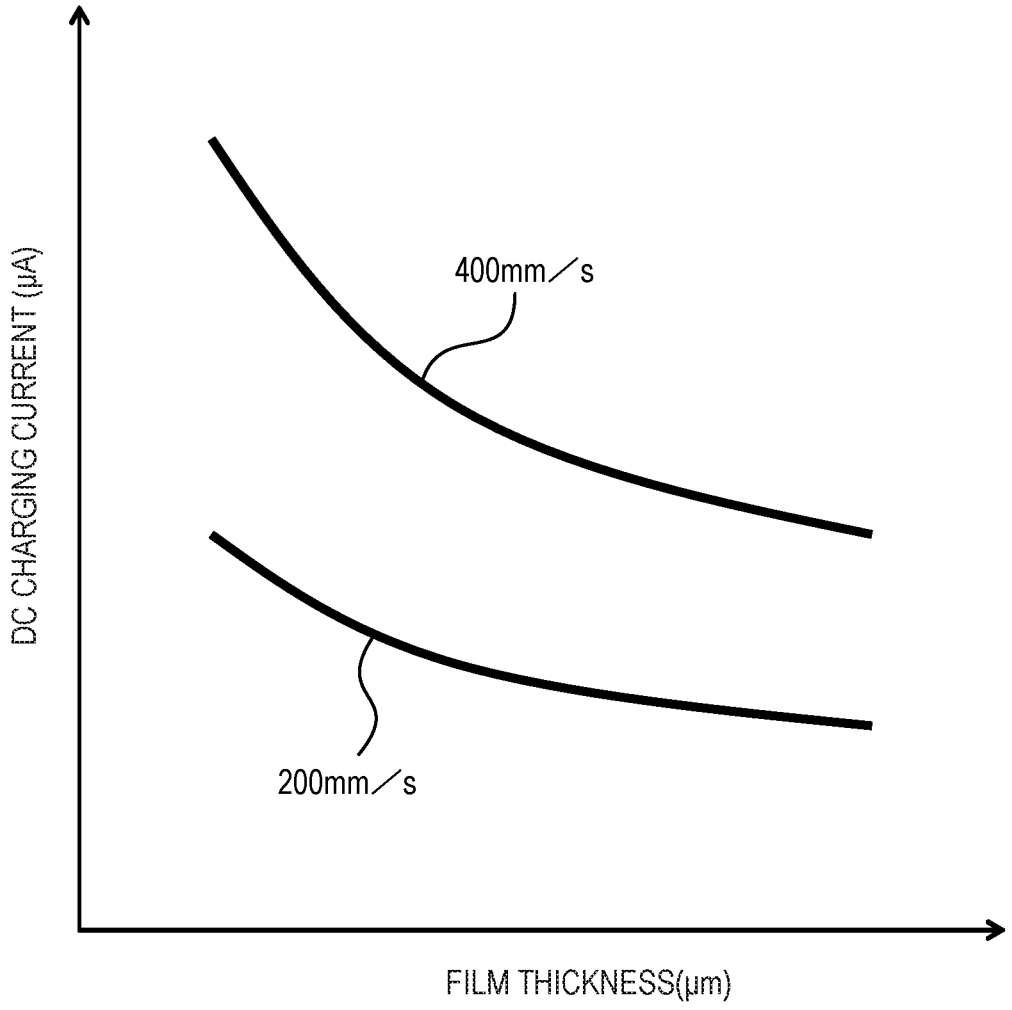
FIG. 7 is a graph illustrating a relationship among the film thickness of the photosensitive drum, the DC charging current and rotational speeds of the photosensitive drum.

The DC charging current I is detected after the rotational speed of the photosensitive drum 1 is increased, and thereby the area of the photosensitive drum 1 increases, which enters into the charging nip portion per unit time. Accordingly, the DC charging current I which is detected becomes relatively large as compared to the decrease amount of the film thickness of the photosensitive drum 1 (see FIG. 7). Accordingly, even though the apparatus has the photosensitive drum 1 of which the rotational speed is slow at the time when the image is formed so as to keep the quality of the output image, the influence of the detection error of the DC charging current I is decreased when calculating the film thickness, and the film thickness can be detected more accurately. In addition, the life of the photosensitive drum 1 can be predicted or detected more accurately based on the calculated film thickness.

Figure 6:
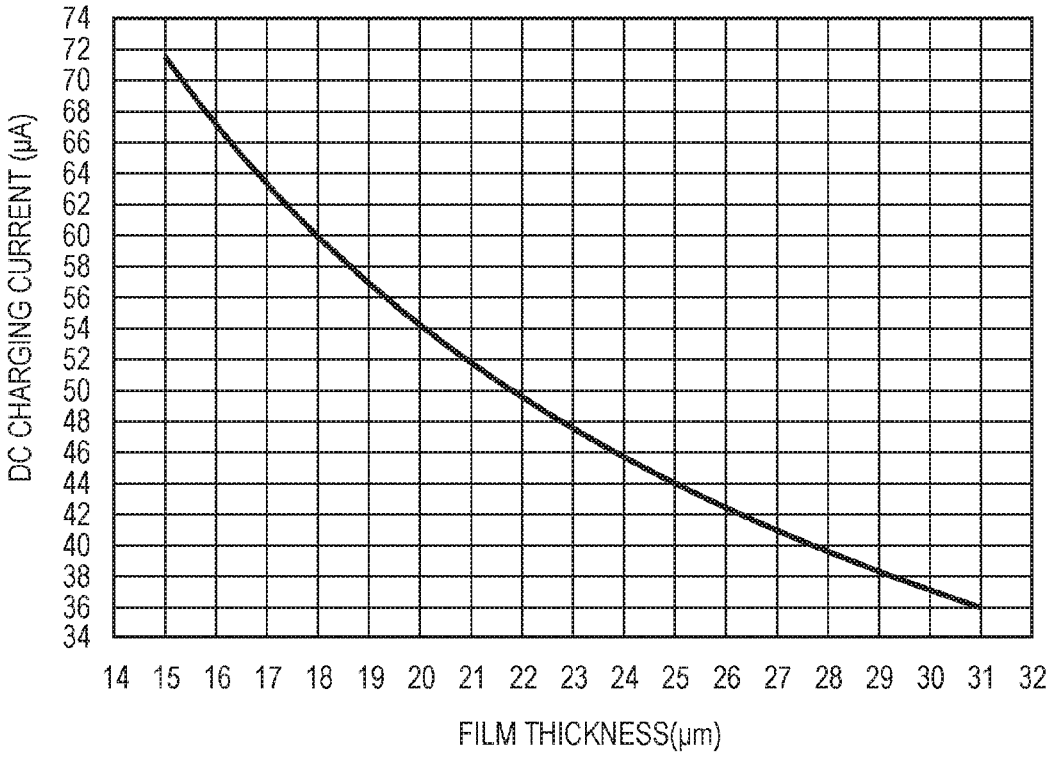
FIG. 6 is a graph illustrating a relationship between a film thickness of the photosensitive drum and the DC charging current.

In the experiment, the value of the DC charging current I which was detected when executing the present sequence was 30 μA in a case that the rotational speed was 200 mm/s, and was 60 μA in a case that the rotational speed was 400 mm/s. The graph is illustrated in FIG. 6 for reference, which illustrates the relationship between the DC charging current I and the film thickness of the photosensitive drum 1 in the configuration of the present embodiment.

It is possible not only to predict or detect the life of the photosensitive drum 1 from the detected film thickness of the photosensitive drum 1, but also to feed back to each set value of members (process member) adjacent to the photosensitive drum 1 according to the detected film thickness.

For instance, control in which the AC charging voltage to be applied to the charging roller 2 when the image is formed is lowered by 10 V at every time when the film thickness of the photosensitive drum 1 decreases by 1 um, is performed. This is because as the film thickness decreases, the capacitance of the photosensitive drum 1 increases, and accordingly even though the AC charging voltage is lowered, the photosensitive drum 1 can be sufficiently charged up to a desired level. Thereby, the photosensitive drum 1 can resist being worn.

Alternatively, in the case where the image forming apparatus has a pre-exposure device (a charge-eliminating unit) which eliminates the drum potential by irradiation with light, the light intensity emitted by the pre-exposure device is decreased as the film thickness of the photosensitive drum 1 decreases. This is because as the film thickness decreases, the light intensity necessary for charge-eliminating the drum potential decreases. Thereby, the power consumption is reduced, which leads to the reduction of the cost.

Furthermore, the primary transfer voltage which is applied to the primary transfer roller 5 when the image is formed is controlled so as to be lowered, at every time when the film thickness of the photosensitive drum 1 decreases. This is because as the film thickness decreases, the capacitance of the photosensitive drum 1 increases, and accordingly even though the primary transfer voltage is lowered, desired transfer can be performed. Thereby, the photosensitive drum 1 can resist being worn.

The film-thickness detection sequence may be executed not only at the above described timing, but also at another timing in the time period while the image is not formed.

In the present embodiment, the film thickness is calculated from the DC charging current I which flows when the photosensitive drum 1 is charged by the charging roller 2, but the present invention is not limited to the above method. Specifically, the member may be any member which can charge the photosensitive drum 1. For instance, the film thickness may also be calculated from an electric current which flows to the photosensitive drum, when the primary transfer voltage is applied to the primary transfer roller 5 to charge the photosensitive drum 1.

The present invention is not limited to an intermediate transfer type of an image forming apparatus A. Specifically, the image forming apparatus may be a direct transfer type for transferring a toner image that is formed on the surface of the photosensitive drum directly onto a sheet. In addition, the image forming apparatus may not be a color type, and may also be a monochrome type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-165920, filed Aug. 25, 2015, which is hereby incorporated by reference herein in its entirety.

What is claimed is:

1. An image forming apparatus comprising:

a photosensitive drum which rotates;

a charging roller which is arranged so as to come into contact with or close to the photosensitive drum;

a power source which applies voltage to the charging roller to charge the photosensitive drum;

a toner-image forming unit which performs image exposure on the charged photosensitive drum based on an image signal, and then forms a toner image on the photosensitive drum by depositing a toner thereon;

a detecting member which detects a DC current flowing from the charging roller to the photosensitive drum;

a driving source which drives to rotate the photosensitive drum; and an execution unit which executes a detection mode to detect the DC current, flowing from the charging roller to the photosensitive drum, with the detecting member when the voltage is applied to the charging roller in a state in which the photosensitive drum is rotated, in a period other than a period during which the toner image is formed on the photosensitive drum, the execution unit sets a speed at which the photosensitive drum is rotated by the driving source at the time when the detection mode is executed to be faster than any speed in the period during which the toner image is formed by the toner-image forming unit.

2. The image forming apparatus according to claim 1, wherein, in the period during which the toner image is formed on the photosensitive drum, the execution unit applies a voltage which is generated by superimposing a DC voltage and an AC voltage, that is larger than a discharge starting voltage at the time when starting discharge between the charging roller and the photosensitive drum, to the charging roller by the power source.

3. The image forming apparatus according to claim 2, wherein, in the detection mode, the execution unit sets the AC voltage which is applied by the power source so that the AC voltage is larger than that in the period during which the toner image is formed by the toner-image forming unit.

4. The image forming apparatus according to claim 2, further comprising:

a control unit which sets an absolute value of the AC voltage to be applied to the charging roller by the power source in the period during which the toner image is formed on the photosensitive drum, the control unit which, when an absolute value of the DC current detected in the detection mode is a first electric current, sets the absolute value of the AC voltage so as to be smaller than an absolute value of the AC voltage when the absolute value of the DC current is a second electric current smaller than the first electric current.

5. The image forming apparatus according to claim 2, further comprising:

a transfer member which transfers the toner image formed on the photosensitive drum onto an object to be transferred;

a transfer power source which applies a transfer voltage, that has a reverse polarity to that of a voltage to be applied to the charging member by the power source, to the transfer member; and a control unit which sets an absolute value of the transfer voltage to be applied to the transfer member by the transfer power source in a period during which the toner image formed on the photosensitive drum is transferred to the object to be transferred, the control unit which, when an absolute value of the DC current detected in the detection mode is a first electric current, sets the absolute value of the transfer voltage so as to be smaller than an absolute value of the transfer voltage when the absolute value of the DC current is a second electric current smaller than the first electric current.

6. The image forming apparatus according to claim 2, further comprising:

a charge-eliminating and exposure member which eliminates charge of the photosensitive drum by exposing with light; and a control unit which sets light intensity of the light with which the charge-eliminating and exposure member exposes the photosensitive drum in a period during which the charge-eliminating and exposure member eliminates the charge of the photosensitive drum, the control unit which, when an absolute value of the DC current detected in the detection mode is a first electric current, sets the light intensity so as to be smaller than light intensity when an absolute value of the DC current is a second electric current smaller than the first electric current.

* * * * *